US006932511B2

(12) United States Patent
Doornbos et al.

(10) Patent No.: US 6,932,511 B2
(45) Date of Patent: Aug. 23, 2005

(54) DAMPED DRAWER SLIDE MECHANISM

(75) Inventors: David A. Doornbos, Manteno, IL (US); Steven L. Bivens, Kankakee, IL (US)

(73) Assignee: Illinois Tool Works Inc., Glenview, IL (US)

( * ) Notice: Subject to any disclaimer, the term of this patent is extended or adjusted under 35 U.S.C. 154(b) by 56 days.

(21) Appl. No.: 10/762,432

(22) Filed: Jan. 22, 2004

(65) Prior Publication Data

US 2004/0197035 A1 Oct. 7, 2004

Related U.S. Application Data

(60) Provisional application No. 60/459,552, filed on Apr. 1, 2003.

(51) Int. Cl.[7] ..... F16C 29/04

(52) U.S. Cl. ..... 384/19; 384/37; 384/7; 384/54

(58) Field of Search ..... 384/18, 19, 7, 384/37, 54

(56) References Cited

U.S. PATENT DOCUMENTS 5,212,999 A * 5/1993 Kitada ..... 384/223
6,866,588 B2 * 3/2005 Doornbos ..... 464/40
2003/0192750 A1 * 10/2003 Doornbos et al. ..... 464/57

* cited by examiner

*Primary Examiner*—Lenard A. Footland
(74) *Attorney, Agent, or Firm*—Mark W. Croll; Paul F. Donovan

(57) ABSTRACT

A slide mechanism includes first and second rails connected for relative sliding movement with respect to each other. A damper mechanism is secured to one of the rails and can be connected to and disconnected from the other of the rails to provide a damping effect for relative movement of the rails during at least a part of the movement thereof.

20 Claims, 3 Drawing Sheets

DAMPED DRAWER SLIDE MECHANISM

CROSS-REFERENCE TO RELATED APPLICATIONS

The present regular application claims the benefits of U.S. Provisional Application Ser. No. 60/459,552 filed on Apr. 1, 2003.

FIELD OF THE INVENTION

The present invention relates to sliding-type closure mechanisms such as those used on kitchen drawers, sliding racks, desk drawers and other cabinets and the like. More particularly, the invention relates to self-closing sliding closure mechanisms having dampers for controlling the rate of movement in at least one direction.

BACKGROUND OF THE INVENTION

For closure mechanisms on racks and drawers in kitchen cabinets, storage units, furniture and the like often it is convenient and helpful to utilize spring assists for moving the mechanism in one direction, typically in the closing direction. With spring assists, the mechanism can be made self-closing, requiring only an initial start to unseat it from a secured, opened position. The mechanism can reduce the effort required for closing, even for heavily loaded drawers or racks, and can ensure that the mechanism closes completely. However, an assist having sufficient strength to close automatically a heavily loaded drawer or the like can cause undesirably abrupt movements and rapid closing, with significant impact upon reaching the fully closed position, especially when the drawer or rack is loaded lightly.

To minimize the undesirable effects of a closing mechanism, it is advantageous to temper, or damp the action of the closing spring or other assist, so that the drawer or the like closes more gently and smoothly. However, it is desirable to deactivate or circumvent the damping mechanism in the opposite direction, that is, when the drawer or rack is being pulled open. Since the opening motion may be done without mechanical assist, and in fact may itself be restrained by the expansion of an extension spring used to assist closing, further damping is not needed and may be undesirable.

It is also known to structure closing mechanism so that gravity assists closing a drawer or rack, with no additional mechanical assist required. In mechanisms of this type, too, it is desirable to damp the closing movement for smooth, gentle closing.

Therefore, it is desirable to provide a self-closing slide mechanism that is simple and effective, and that can be provided to be operational in one direction.

SUMMARY OF THE INVENTION

The present invention provides an activation arm for the damper of slide mechanisms, which cooperates with the slide mechanism to engage the damper when the slide mechanism is moved in one direction, and to disengage the damper when the slide mechanism is moved in an opposite direction.

In one aspect thereof, the present invention provides a damped slide mechanism with a first rail and a second rail engaged with each other and allowing sliding movement relative to each other. A damper mechanism is arranged to influence movement of at least of the rails with respect to the other of the rails. The damper mechanism includes a gear damper having a rotor and a gear drivingly connected to the rotor. The rotor has controlled, resisted rotation within the damper. A body has gear teeth drivingly connected to the gear of the damper. The body has an arm extending outwardly therefrom. One of the rails defines a slot for capturing the arm during relative movement of the rails.

In another aspect thereof, the present invention provides a damper mechanism with a base and a gear damper including a housing secured to the base. A rotor rotatably disposed in the housing extends outwardly therefrom. A gear is drivingly connected to the rotor. A body rotatably disposed on the base has gear teeth drivingly engaging the gear on the rotor. The body includes an arm projecting therefrom and adapted to engage a structure, the relative movement of which is to be damped.

In still another aspect thereof, the present invention provides a slide mechanism with a stationary rail and a movable rail engaged with the stationary rail for sliding movement relative to the stationary rail. A gear damper is secured to the stationary rail. A body rotatable relative to the stationary rail has gear teeth thereon engaging the gear damper. An arm connected to the body projects toward the movable rail. A slot defined in the movable rail is positioned in the movable rail to engage the arm during at least a portion of a path of relative sliding movement of the movable rail with respect to the stationary rail.

Other features and advantages of the invention will become apparent to those skilled in the art upon review of the following detailed description, claims and drawings in which like numerals are used to designate like features.

Figure 1:
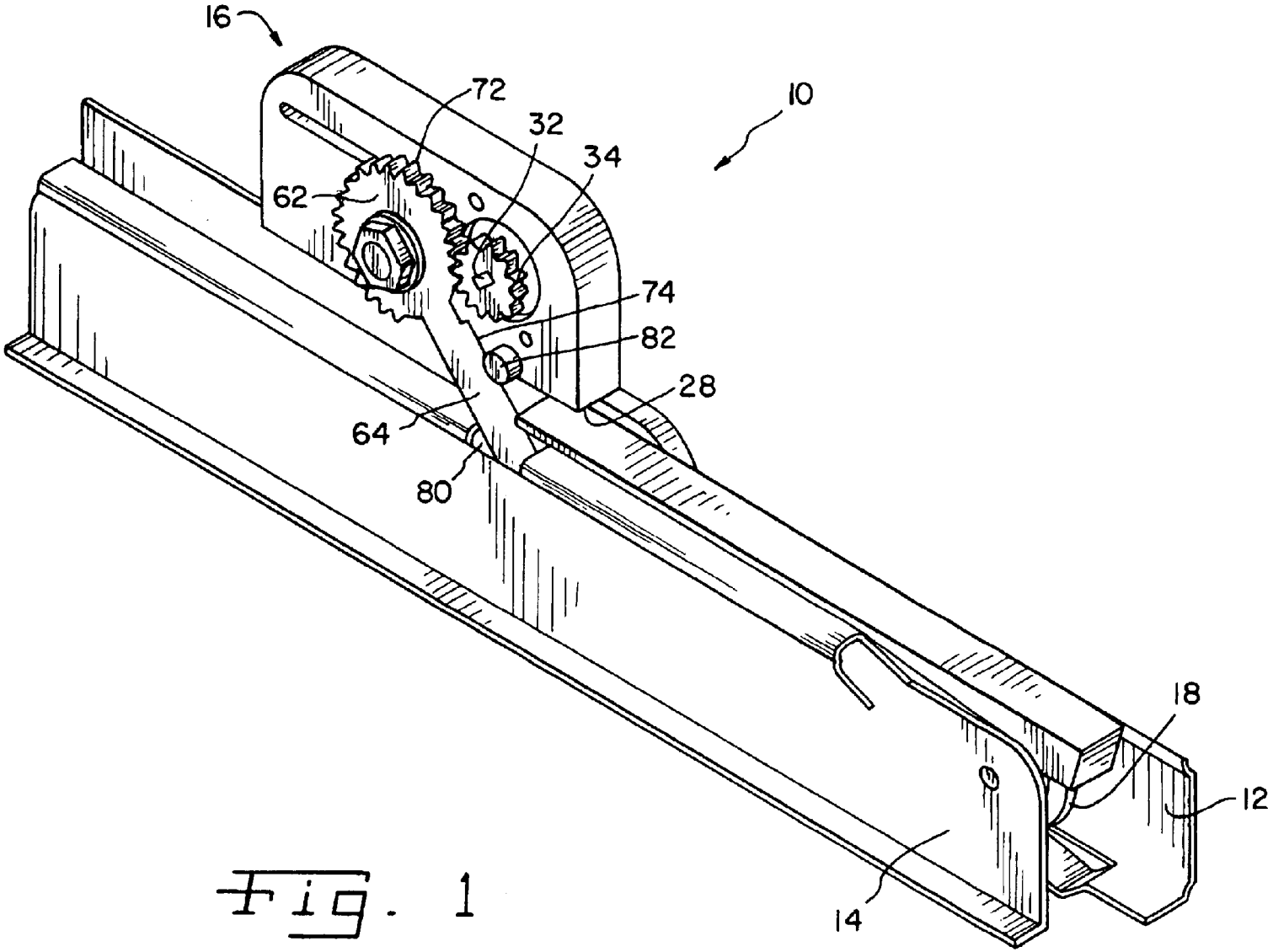
FIG. 1 is a perspective view of a damped drawer slide mechanism of the present invention, shown in a closed position.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings and to FIG. 1 in particular, a damped draw slide mechanism 10 in accordance with the present invention is shown. Drawer slide mechanism 10 includes a stationary rail 12 and a movable rail 14. A damper mechanism 16 is operatively associated with rails 12 and 14 to provide a measure of control on the relative sliding movement between rails 12 and 14.

In the exemplary embodiment shown, damped drawer slide mechanism 10 is particularly suitable for use on a drawer such as in a cabinet or the like, and rails 12 and 14 are designed for attachment to the drawer frame (not shown) and drawer (not shown), respectively. It should be understood that the size and shape of rails of 12 and 14 may vary, depending on the size and capacity of the drawer, shelf, cabinet or the like to which each is attached. The concepts of the present invention work advantageous with a variety of rail and support configurations.

Those skilled in the art will understand that, in the exemplary embodiment shown, rails 12 and 14 include ramps, channels and the like for containing and directing a plurality of rollers 18 provided on one or both of rails 12 and 14, one such roller 18 being shown. In this way, rails 12 and 14 mutually interconnect one to the other and allow sliding movement of rails 12 and 14 relative to one another.

Damper mechanism 16 is attached to stationary rail 12 and is operatively connectable to movable rail 14 to influence the movement of movable rail 14 relative to stationary rail 12, at least in one direction of movement for movable rail 14. The manner in which damper mechanism 16 connects to movable rail 14 will be described hereinafter.

Figure 3:
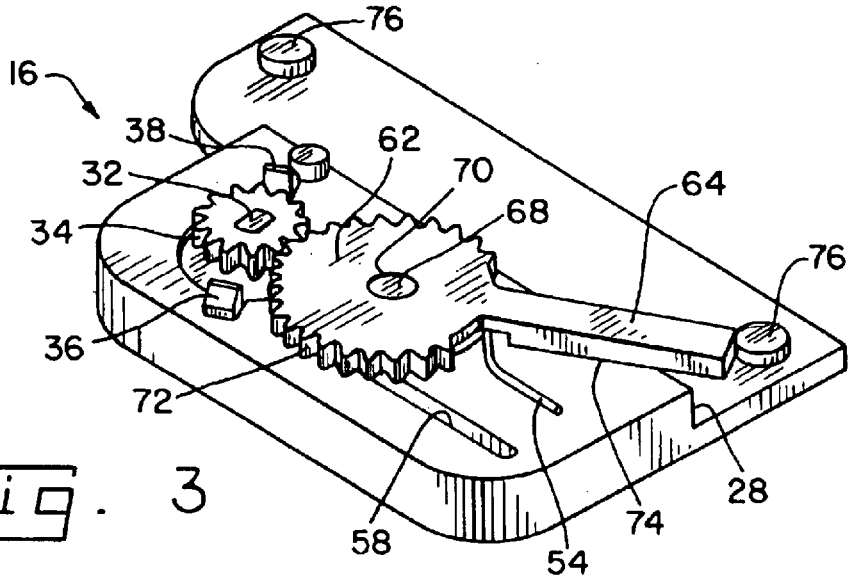
FIG. 3 is a perspective view of the damper for the slide mechanism shown in the previous drawings.
Figure 4:
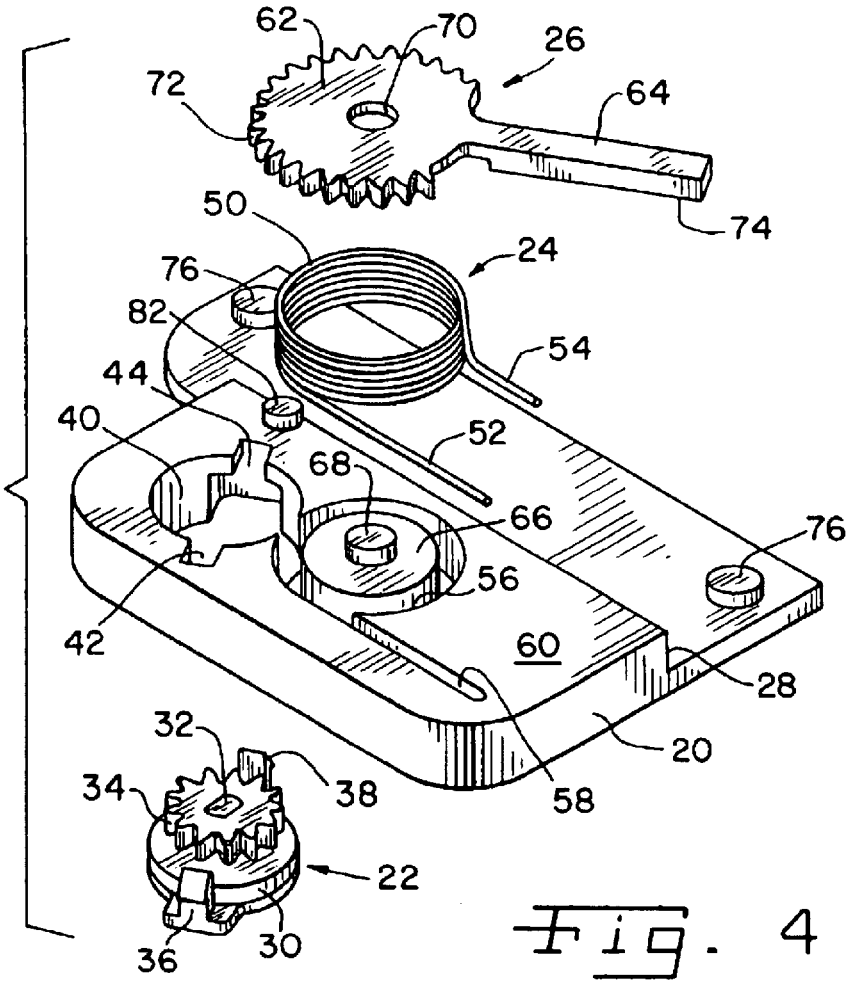
FIG. 4 is an exploded view of the damper shown in FIG. 3.

Damper mechanism 16 is shown in greater detail in FIGS. 3 and 4. Damper mechanism 16 includes a base 20, a rotary gear damper 22, a spring 24 and a rotatable body referred to herein as an armed gear 26. Base 20 is configured to hold gear damper 22, spring 24 and armed gear 26, and is further adapted for mounting to stationary rail 12. To position base 20 properly on stationary rail 12, base 20 is provided with a ledge 28 to rest against a side and edge of rail 12.

Gear damper 22 includes a housing 30 having a rotor 32 operatively disposed therein and extending outwardly therefrom. A gear 34 is drivingly connected to rotor 32. Damper 22 can be a so-called "one-way" damper or a so-called "two-way" damper with rotational resistance provided to rotor 32. Housing 30 is sealed structure and contains a viscous fluid or other internal structures that provide resistance to rotation of rotor 32 within damper housing 30. For mounting, housing 30 includes opposed outwardly extending lobes 36 and 38.

Base 20 defines a well 40 for receiving damper 22. Well 40 includes opposed notches 42 and 44 for receiving lobes 36 and 38, respectively. Thus, when disposed in well 40, gear damper 22 is fixed in position relative to base 20 in that lobes 36, 38 received in notches 42, 44 resist rotation of the otherwise generally round housing 30 in otherwise generally round well 40.

Spring 24 has a plurality of coils 50 and outwardly extending tails 52 and 54 from opposite end most coils 50. Base 20 includes an annular channel 56 with an elongated linear channel 58 extending therefrom. Annular channel 56 and linear channel 58 are sized and arranged to receive spring 24 such that tail 52 is received in linear channel 58 and most all of coils 50 are received in annular channel 56. Tail 54 on the opposite side of coils 50 from tail 52 is held against a surface 60 of base 20. Alternatively, tail 54 can be installed in a groove (not shown) on the bottom side of gear arm 64.

Armed gear 26 includes a gear body 62 and a gear arm 64 projecting radially outwardly from gear body 62. Annular channel 56 is partly defined by a center pillar 66 having a knob 68 thereon. Gear body 62 defines a hole 70 for sliding onto knob 68 so as to allow relative rotational movement between gear body 62 and knob 68.

Gear body 62 defines a series of gear teeth 72 at the periphery thereof. Gear damper 22 and armed gear 26 are positioned on base 20 such that gear 34 of gear damper 22 operatively engages gear teeth 72 of armed gear 26 (FIG. 3).

Gear arm 64 includes a lip 74 projecting towards surface 60. Lip 74 slides along surface 60, or minimally spaced therefrom, as armed gear 26 is rotated. Thus, lip 74 can engage tail 54 on surface 60. Alternatively, as previously described, gear arm 64 can include a slot or groove in the bottom side thereof to receive the tail 54.

Figure 2:
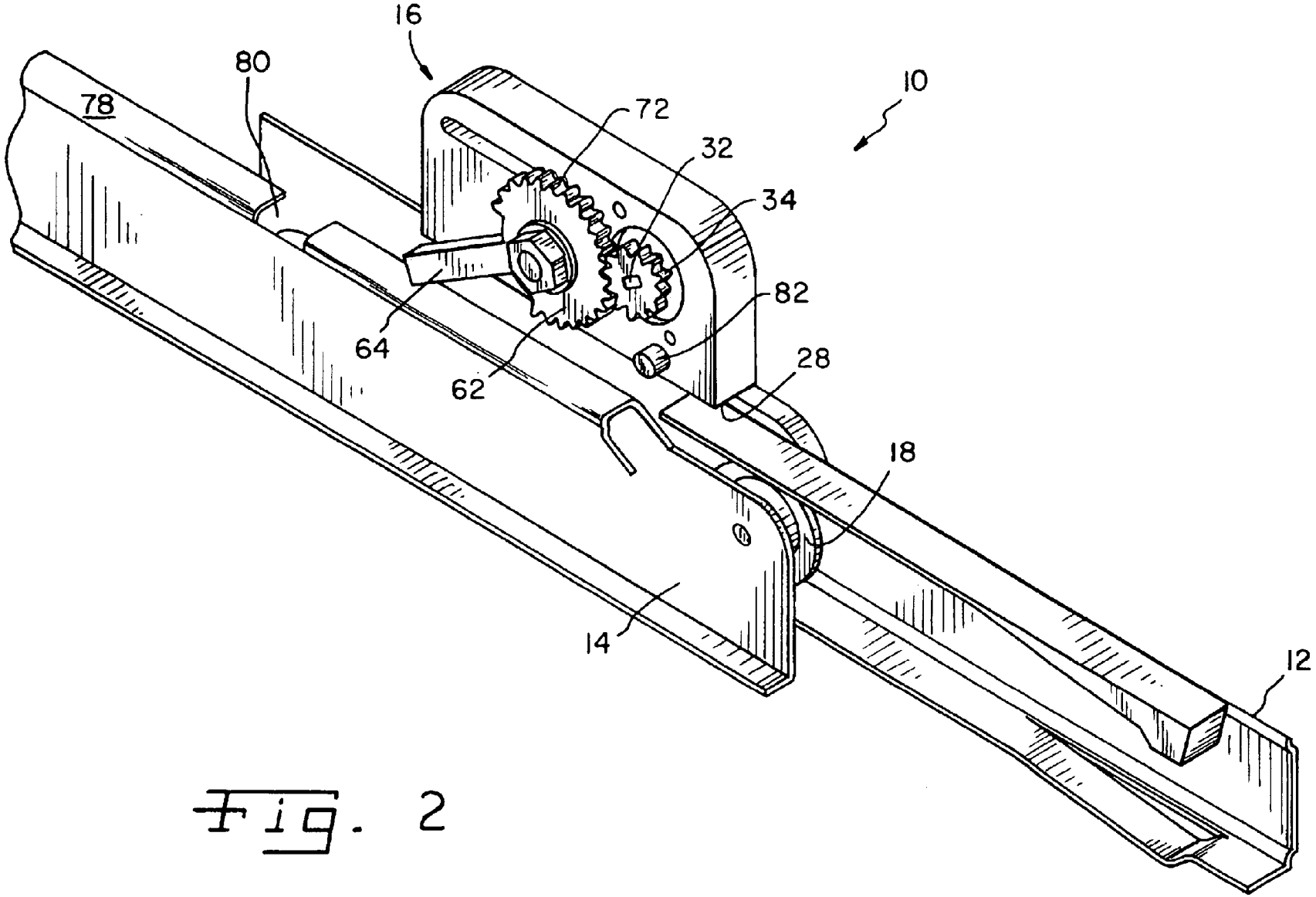
FIG. 2 is a perspective view of the slide mechanism of FIG. 1, but shown in an opened position.

With reference to FIGS. 1 and 2, damper mechanism 16 is shown affixed to stationary rail 12, which can be achieved by a variety of means, including but not limited to welding, screws, bolts, adhesive or rivet posts 76 (FIGS. 3 and 4). Gear arm 64 projects toward an edge surface 78 of movable rail 14. Along surface 78, movable rail 14 defines a slot 80, which can engage gear arm 64 when aligned with the distal end thereof. An abutment 82 is provided to limit rotation of armed gear 26 by spring 24. As can be appreciated, a pin or other structure or arrangement can be used in place of slot 80 for engagement with gear arm 64. Moreover, the end of the rail 14 could engage the gear arm 64, or even an associated drawer itself could be adapted to engage the gear arm 64.

In operation, as a drawer or the like is pulled open such that movable rail 14 slides relative to stationary rail 12 to an opened position as shown in FIG. 2, gear arm 64 is disengaged from slot 80 to slide along moving surface 78. From the position shown in FIG. 2, when the drawer is pushed closed, surface 78 slides past gear arm 64 until slot 80 aligns with the distal end of gear arm 64, which then enters slot 80. Spring 24 is configured and arranged in damper mechanism 16 to urge rotation of armed gear 26 so that arm 64 thereof is urged into and against slot 80, to in turn urge movable rail 14 toward the closed position shown in FIG. 1. With teeth 72 of gear body 62 engaged with gear 34 of gear damper 22, the damping performance of gear damper 22 is thereby imparted to the rotation of armed gear 26, in opposition to the operation of spring 24 against armed gear 26. Consequently, the damping effect of gear damper 22 is imparted to the closing movement of movable rail 14, and the closing force from spring 24 is damped by gear damper 22.

As mentioned previously herein, the present invention is capable of various modifications and alterations such that the rails are suited for the structures on which they are applied. Further, in some configurations gravity assist can be used to move movable rail 14 towards the closed position. In such configurations, spring 24 is not required, and the closing force imparted by gravity is damped by the operation of gear damper 22. It should also be understood that the operation of damper mechanism 16 can be reversed relative to the movement of movable rail 14, such that damping force is applied as movable rail 14 is moved towards the opened position shown in FIG. 2. This can be particularly useful in self-opening drawers or bins that move automatically towards the open position when a lock or other catch is released. Further, although shown and described herein with damper mechanism 16 mounted on stationary rail 12, those skilled in the art will readily understand that damper mechanism 16 also can be mounted on movable rail 14, with slot 80 provided in stationary rail 12. As yet another alternative, damper mechanism 16 can be operatively connected to the drawer framework or other structure near to the sliding drawer, shelf or the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A damped slide mechanism comprising:

a first rail and a second rail engaged with each other and allowing sliding movement relative to each other;

a damper mechanism arranged to influence movement of at least one of said rails with respect to the other of said rails, said damper mechanism including:

a gear damper having a rotor and a gear drivingly connected to said rotor, said rotor having controlled resisted rotation in said damper; and a body having gear teeth thereon drivingly connected to said gear of said damper, said body having an arm extending outwardly therefrom; and one of said rails adapted to engage said arm during relative movement of said rails.

2. The slide mechanism of claim 1, said damper mechanism being connected to one of said rails, and the other of said rails including a slot for capturing said arm during relative movement of said rails.

3. The slide mechanism of claim 2, one of said rails being stationary and the other of said rails being movable.

4. The slide mechanism of claim 3, said damper mechanism being connected to said stationary rail.

5. The slide mechanism of claim 4, including a spring operatively engaging said arm for urging movement of said body.

6. The slide mechanism of claim 4, said damper mechanism including a base configured to hold said gear damper and said body.

7. The slide mechanism of claim 6, said base defining a well for receiving and securing said gear damper therein.

8. The slide mechanism of claim 7, said base defining a knob and said body being disposed rotatably on said knob.

9. The slide mechanism of claim 8, said base defining an annular channel around said knob and beneath said body, and a spring being disposed in said annular channel and engaging said arm.

10. The slide mechanism of claim 1, said damper mechanism including a base configured to hold said gear damper and said body.

11. The slide mechanism of claim 10, said base defining a well for receiving and securing said gear damper therein.

12. The slide mechanism of claim 10, said base defining a knob and said body being disposed rotatably on said knob.

13. The slide mechanism of claim 12, said base defining an annular channel around said knob and beneath said body, and a spring being disposed in said annular channel and engaging said arm.

14. A damper mechanism, comprising:

a base;

a gear damper including a housing secured to said base non-rotatably relative thereto, a rotor rotatably disposed in said housing and extending outwardly therefrom and a gear drivingly connected to said rotor; and a body rotatably disposed on said base, said body having gear teeth thereon drivingly engaging said gear on said rotor, said body including an arm projecting therefrom said arm adapted to engage a structure the relative movement of which is to be damped.

15. The damper mechanism of claim 14, said base defining a well for receiving said gear damper therein.

16. The damper mechanism of claim 14, said base defining a knob and said body being disposed rotatably on said knob.

17. The damper mechanism of claim 16, said base defining an annular channel around said knob and beneath said body, and a spring being disposed in said annular channel and operatively engaging said arm.

18. A slide mechanism comprising:

a stationary rail;

a movable rail engaged with said stationary rail for sliding movement relative to said stationary rail;

a gear damper secured to said stationary rail, said gear damper having a rotatable gear;

a body rotatable relative to said stationary rail, said body having gear teeth thereon engaging said gear of said gear damper;

an arm connected to said body, said arm projecting toward said movable rail; and a slot defined in said movable rail, said slot positioned in said movable rail to engage said arm during at least a portion of a path of relative sliding movement of said movable rail with respect to said stationary rail.

19. The slide mechanism of claim 18 including a base secured to said stationary rail, said base configured to hold said gear damper nonrotatably relative thereto and to hold said body rotatably relative thereto.

20. The slide mechanism of claim 18 including a spring operatively engaging said arm during at least part of the relative rotational movement of said body, said spring urging rotation of said body.

* * * * *